US008727951B2

(12) United States Patent
Jones et al.

(10) Patent No.: US 8,727,951 B2
(45) Date of Patent: May 20, 2014

(54) WEIGHT TRAINING DEVICE AND METHOD OF USE

(75) Inventors: Corey D. Jones, Lavon, TX (US); Marshall T. Long, Farmersville, TX (US)

(73) Assignee: Rogue Wave Industries, LLC, Lavon, TX (US)

( * ) Notice: Subject to any disclaimer, the term of this patent is extended or adjusted under 35 U.S.C. 154(b) by 511 days.

(21) Appl. No.: 13/098,737

(22) Filed: May 2, 2011

(65) Prior Publication Data

US 2012/0283072 A1 Nov. 8, 2012

(51) Int. Cl.
*A63B 21/06* (2006.01)
*A63B 21/075* (2006.01)

(52) U.S. Cl.
USPC ..... 482/93; 482/139; 482/109; 482/110

(58) Field of Classification Search
USPC ..... 482/93, 51, 55–56, 106–109, 110, 139
See application file for complete search history.

(56) References Cited

U.S. PATENT DOCUMENTS

| | | | | | |
|---|---|---|---|---|---|
| 3,845,952 | A | * | 11/1974 | McKinney | 472/127 |
| 4,079,932 | A | * | 3/1978 | Schuetz | 482/82 |
| 4,398,595 | A | * | 8/1983 | Small | 165/109.1 |
| 4,413,394 | A | * | 11/1983 | Small | 29/890.045 |
| 4,627,613 | A | * | 12/1986 | Solloway | 482/111 |
| 4,647,037 | A | * | 3/1987 | Donohue | 482/82 |
| 4,703,927 | A | * | 11/1987 | Hanzlik | 482/74 |
| 4,773,640 | A | * | 9/1988 | Kolbel et al. | 482/108 |
| 4,819,951 | A | * | 4/1989 | Solloway | 482/111 |
| 4,854,575 | A | * | 8/1989 | Wilson et al. | 482/108 |
| 5,050,870 | A | * | 9/1991 | Pollock | 482/105 |
| 5,445,587 | A | * | 8/1995 | Brown | 482/108 |
| 5,716,305 | A | | 2/1998 | Selsam | |
| 5,857,946 | A | * | 1/1999 | Brown | 482/108 |
| 6,099,441 | A | * | 8/2000 | Bonnet | 482/93 |
| 6,149,555 | A | | 11/2000 | Kinback | |
| 6,241,641 | B1 | * | 6/2001 | Sawyer | 482/108 |
| 6,312,364 | B1 | * | 11/2001 | Selsam | 482/93 |

(Continued)

FOREIGN PATENT DOCUMENTS

| | | |
|---|---|---|
| FR | 2596284 A1 | 10/1987 |
| GB | 2474062 A | 4/2011 |

OTHER PUBLICATIONS

European Patent Office; International Search Report and Written Opinion; PCT Application No. PCT/US2012/061734; Jul. 9, 2013.

*Primary Examiner* — Stephen Crow
(74) *Attorney, Agent, or Firm* — Jackson Walker L.L.P.; Christopher J. Rourk

(57) ABSTRACT

A weight training device comprising a hollow tubular body. A plurality of handle wells disposed in the hollow tubular body. A plurality of handles disposed in the handle wells, wherein the plurality of handles comprise axially-oriented handles and circumferentially-oriented handles, and wherein the axially-oriented handles are diametrically opposed to the circumferentially-oriented handles. A fill cap well disposed in the hollow tubular body. A fill cap disposed in the fill cap well and removably attached to the hollow tubular body, wherein the fill cap is threaded and is attached to a threaded extrusion of the hollow tubular body. A plurality of baffles disposed within the hollow tubular body, wherein the hollow tubular body is configured to be used partially filled with a fill material so as to create a randomly variable weight distribution. Two diametrically-opposed end caps are attached to the axial ends of the hollow tubular body.

10 Claims, 3 Drawing Sheets

(56) References Cited

U.S. PATENT DOCUMENTS

| | | | | |
|---|---|---|---|---|
| 6,709,371 | B2 * | 3/2004 | Wu | 482/108 |
| 6,730,004 | B2 * | 5/2004 | Selsam | 482/93 |
| D520,366 | S | 5/2006 | Fonnesbeck | |
| 7,244,220 | B2 * | 7/2007 | Carney | 482/106 |
| D563,490 | S * | 3/2008 | Prenatt | D21/680 |
| 7,617,821 | B2 * | 11/2009 | Hughes | 128/200.24 |
| 7,758,477 | B2 | 7/2010 | Prenatt | |
| 8,443,796 | B2 * | 5/2013 | Hughes | 128/200.24 |
| 2007/0287600 | A1 | 12/2007 | Prenatt | |
| 2010/0009820 | A1 | 1/2010 | Dalcourt | |
| 2011/0251030 | A1 * | 10/2011 | Pfitzer | 482/110 |
| 2012/0149536 | A1 * | 6/2012 | Trimble et al. | 482/93 |
| 2012/0172182 | A1 * | 7/2012 | Leier et al. | 482/108 |
| 2012/0283073 | A1 | 11/2012 | Zabel | |
| 2013/0196830 | A1 * | 8/2013 | Pfitzer | 482/110 |

* cited by examiner

WEIGHT TRAINING DEVICE AND METHOD OF USE

FIELD OF THE INVENTION

The present invention pertains to the field of weight training, and more specifically to a weight training device and method of use.

BACKGROUND OF THE INVENTION

Weight training devices are known in the art. Most weight training devices exercise a small number of muscle groups, because of the way that they are designed and constructed.

SUMMARY OF THE INVENTION

In accordance with the present invention, a weight training device and method of use are provided that exercise a large number of muscle groups by using a device with a varying mass distribution, where the speed of variation is controlled to prevent injury.

In accordance with an exemplary embodiment of the present invention, a weight training device comprising a hollow tubular body is provided. A plurality of handle wells are disposed in the hollow tubular body, and a plurality of handles are disposed in the handle wells, wherein the plurality of handles comprise axially-oriented handles and circumferentially-oriented handles, and wherein the axially-oriented handles are diametrically opposed to the circumferentially-oriented handles. A fill cap well is disposed in the hollow tubular body, with a fill cap in the fill cap well and removably attached to the hollow tubular body. The fill cap is threaded and can be attached to a threaded extrusion of the hollow tubular body. A plurality of baffles are disposed within the hollow tubular body, wherein the hollow tubular body is configured to be used partially filled with a fill material so as to create a randomly variable weight distribution. Two diametrically-opposed end caps are attached to the axial ends of the hollow tubular body.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
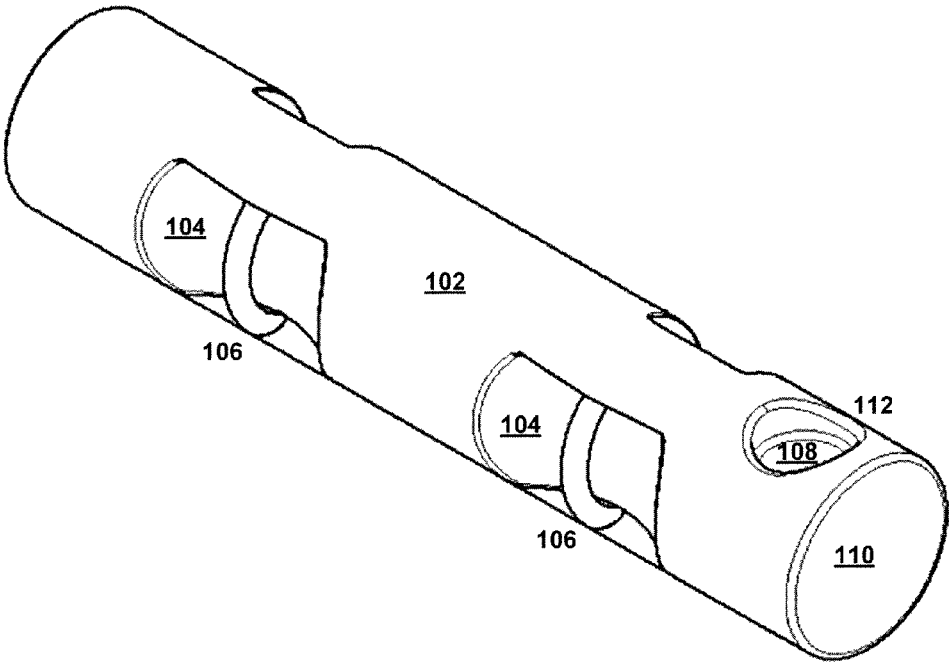
FIG. 1 is a perspective view of a weight training device in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a perspective view of a weight training device 100 in accordance with an exemplary embodiment of the present disclosure. Weight training device 100 provides a variable mass distribution that trains a large number of different muscles, while being sufficiently controlled to prevent injury.

Weight training device 100 includes outer housing 102, which can be made from molded or extruded plastic or other suitable materials. Outer housing 102 contains a number of interior baffles, and can be filled with water or other suitable materials through fill cap 108 and fill cap well 112. Fill cap 108 can be connected to a threaded penetration in outer housing 102, or other suitable mechanisms can be used to provide a secure and watertight seal between fill cap 108 and outer housing 102, such as by embedding a threaded sealing device within outer housing 102 to form the penetration during the molding process. Fill cap 108 fits within fill cap well 112, which protects fill cap 108 from inadvertent removal (which can result in a spill of the fill material) or damage during use. In one exemplary embodiment, fill cap 108 can be moved to the side within fill cap well 112 during filling or emptying of weight training device 100, and can be restrained from removal by fill cap well 112 (such as by sizing the opening to fill cap well 112 to be smaller than fill cap 108 or using other suitable restraining devices), so as to protect fill cap 108 from inadvertent loss.

The distribution of the interior baffles allows the fill material to redistribute itself at a speed "FS," where the speed FS is a function of the flow properties of the fill material (e.g. viscosity, density) and the baffle configuration. Different interior baffle designs can be used to provide different speeds FS, such as ranging from a relative speed of 1.0 (equivalent to no baffles) to a relative speed of 0.0 (such as when the weight training device is completely filled with fill material).

Weight training device 100 includes wells 104 and circumferential handles 106, which can be molded or extruded during the formation of outer housing 102, or otherwise manufactured. Circumferential handles 106 allow a user to lift weight training device 100 using both hands oriented facing towards or away from each other, or facing in the same axial direction. A user can also use a single hand to lift weight training device 100 using circumferential handles 106, such as to lift weight training device 100 upwards in an axial direction.

End cap 110 of weight training device 100 can be molded or extruded during the formation of outer housing 102, or otherwise manufactured. In one exemplary embodiment, end cap 110 can be glued or welded onto outer housing 102 after interior baffles have been installed. End cap 110 is configured to withstand hydraulic forces from the fill material within outer housing 102 as well as external forces that may be encountered during use, such as if a user drops weight training device 100 on end cap 110 from a maximum expected height, such as eight feet.

In operation, weight training device 100 can be manufactured using plastic, rubber or other durable synthetic materials by molding, extrusion, or in other suitable manners. Weight training device 100 can then be shipped and stored without fill material, such that weight training device 100 is significantly lighter during shipping and storage than it will be in use. For use, weight training device 100 can be filled with water, sand or other suitable materials, such that a user can control both the weight of weight training device 100 as well as the dynamic weight distribution properties of weight training device. In one exemplary embodiment, when weight training device is completely filled, then the weight of weight training device 100 will be at a maximum, but the dynamic weight distribution properties will be at a minimum, or essentially zero. In another exemplary embodiment, weight training device 100 can be partially filled with water, which will decrease the weight of weight training device 100 from a maximum amount but which will increase the dynamic weight distribution properties, so that when a user is exercising with weight training device 100, the fill material inside of weight training device 100 can redistribute in a quasi-random manner, based on the orientation of the interior baffles, the orientation of weight training device 100, and other variables. In this manner, the dynamically-varying weight distribution will cause different muscle groups to be exercised, which is beneficial.

Figure 2:
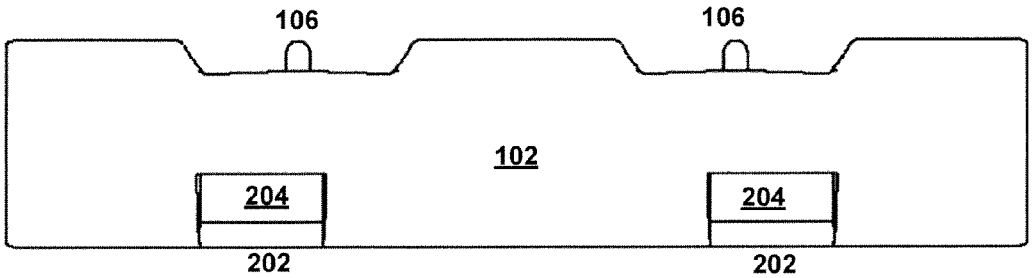
FIG. 2 is a side view of a weight training device in accordance with an exemplary embodiment of the present disclosure.

FIG. 2 is a side view 200 of weight training device 100 in accordance with an exemplary embodiment of the present disclosure. Side view 200 shows circumferential handles 106 and axial handles 202 in wells 204 of weight training device 100, which can be molded or extruded during the formation of outer housing 102, or otherwise manufactured. Axial handles 202 allow a user to lift weight training device 100 using both hands oriented facing in the same radial direction, and provide additional flexibility in weight training use.

Figure 3:
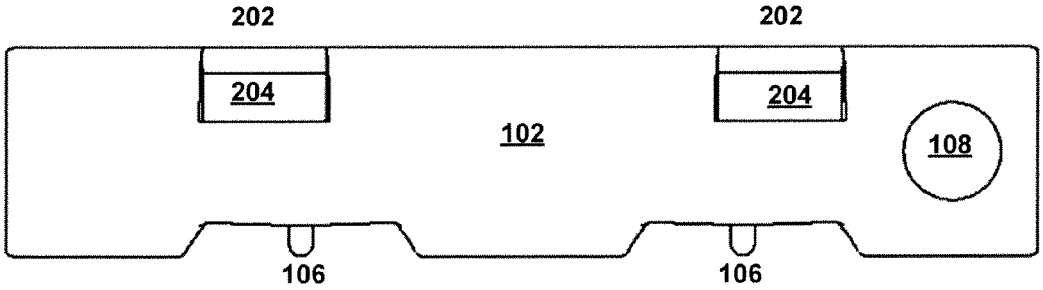
FIG. 3 is a side view of a weight training device in accordance with an exemplary embodiment of the present disclosure.

FIG. 3 is a side view 300 of weight training device 100 in accordance with an exemplary embodiment of the present disclosure. Side view 300 shows circumferential handles 106 and axial handles 202 in wells 204 of weight training device 100, as well as fill cap 108.

Figure 4:
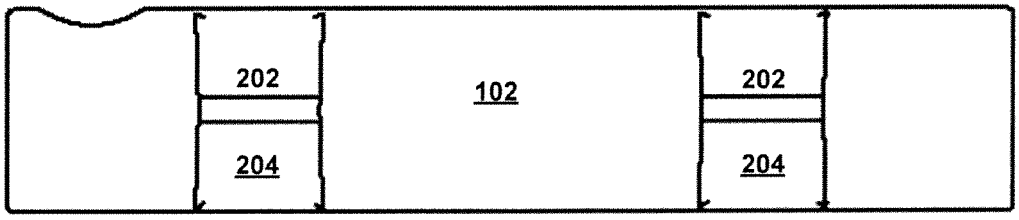
FIG. 4 is a side view of a weight training device in accordance with an exemplary embodiment of the present disclosure.

FIG. 4 is a side view 400 of weight training device 100 in accordance with an exemplary embodiment of the present disclosure. Side view 400 shows axial handles 202 in wells 204 of weight training device 100.

Figure 5:
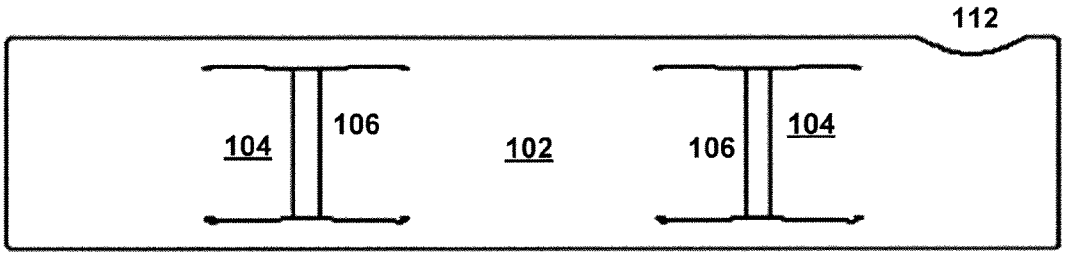
FIG. 5 is a side view of a weight training device in accordance with an exemplary embodiment of the present disclosure.

FIG. 5 is a side view 500 of weight training device 100 in accordance with an exemplary embodiment of the present disclosure. Side view 400 shows circumferential handles 106 in wells 104 of weight training device 100, and part of fill cap well 112.

Figure 6:
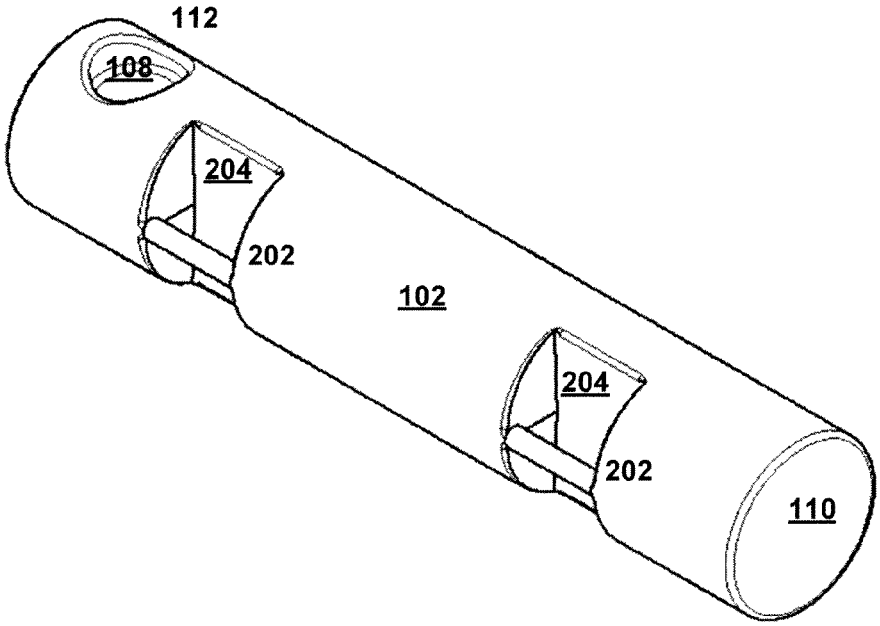
FIG. 6 is a perspective view of a weight training device in accordance with an exemplary embodiment of the present disclosure.

FIG. 6 is a perspective view 600 of weight training device 100 in accordance with an exemplary embodiment of the present disclosure. Perspective view 600 shows axial handles 202 in wells 204, fill cap 108 and fill cap well 112 of weight training device 100.

Figure 7:
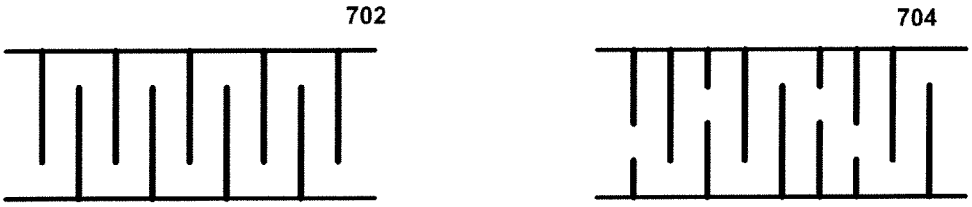
FIG. 7 is a diagram of baffles in accordance with exemplary embodiments of the present invention.

FIG. 7 is a diagram of baffles 700 in accordance with exemplary embodiments of the present invention. Baffles 700 include regular baffle 702 and irregular baffle 704. Regular baffle 702 includes regularly sized and spaced baffle structures that are identical, so as to create a relatively constant mass distribution effect when a fill material flows through the baffle structure or is otherwise redistributed. Irregular baffle 704 includes randomly sized and spaced baffle structures that are non-uniform, so as to create a relatively variable mass distribution effect when a fill material flows through the baffle structure or is otherwise redistributed. In general, more muscle groups will be exercised by irregular baffle 704 than regular baffle 702, but irregular baffle 704 may be more difficult to control, due to the random configuration of irregular baffle 704. The baffle structures 702 and 704 can be made from molded plastics, extruded plastics, polymers, or other suitable materials, and can be molded with or inserted into a weight training device 100 after it is fabricated or during fabrication, or in other suitable manners.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. A weight training device comprising: a hollow tubular body comprising a plurality of identical baffles and a plurality of non-identical baffles; a plurality of handle wells disposed in the hollow tubular body; a plurality of handles disposed in the handle wells, each of the handles enclosed by one of the handle wells; a fill cap well disposed in the hollow tubular body and configured to prevent user contact with a fill cap during use; and the fill cap disposed in the fill cap well and removably attached to the hollow tubular body;

wherein said plurality of handles comprises a plurality of first handles disposed in first handle wells, the plurality of first handles extending in an axial direction, and opposite a plurality of second handles disposed in second handles wells that are isolated from the first handle wells, the plurality of second handles extending in a circumferential direction.

2. The weight training device of claim 1 wherein the plurality of handles comprise handles extending in a circumferential direction.

3. The weight training device of claim 1 wherein the plurality of second handles are each disposed in a corresponding arc-shaped second handle well.

4. The weight training device of claim 1 wherein the fill cap is threaded and is attached to a threaded extrusion of the hollow tubular body.

5. The weight training device of claim 1 wherein the fill cap is threaded and is attached to a threaded attachment embedded in the hollow tubular body.

6. The weight training device of claim 1 wherein the plurality of identical baffles are disposed within the plurality of non-identical baffles.

7. The weight training device of claim 1 wherein the plurality of handles comprise handles extending in a circumferential direction around the circumference of the hollow tubular body.

8. The weight training device of claim 1 wherein the plurality of handles comprise axially-oriented handles and circumferentially-oriented handles, and wherein the axially-oriented handles are diametrically opposed to the circumferentially-oriented handles.

9. The weight training device of claim 1 wherein the hollow tubular body is configured to be used partially filled with a fill material so as to create a randomly variable weight distribution.

10. A weight training device comprising:

a hollow tubular body;

a plurality of handle wells disposed in the hollow tubular body;

a plurality of handles disposed in the handle wells, wherein the plurality of handles comprise axially-oriented handles and circumferentially-oriented handles, and wherein the axially-oriented handles are diametrically opposed to the circumferentially-oriented handles;

a fill cap well disposed in the hollow tubular body;

a fill cap disposed in the fill cap well and removably attached to the hollow tubular body, wherein the fill cap is threaded and is attached to a threaded extrusion of the hollow tubular body;

a plurality of identical baffles disposed within the hollow tubular body;

a plurality of non-identical baffles disposed within the hollow tubular body, wherein the hollow tubular body, the plurality of identical baffles and the plurality of non-identical baffles is configured to be used partially filled with a fill material so as to create a randomly variable weight distribution; and two diametrically-opposed end caps attached to the axial ends of the hollow tubular body.

* * * * *